US008986070B2

(12) United States Patent
Pietsch et al.

(10) Patent No.: US 8,986,070 B2
(45) Date of Patent: Mar. 24, 2015

(54) METHOD FOR TRIMMING THE WORKING LAYERS OF A DOUBLE-SIDE GRINDING APPARATUS

(71) Applicant: Siltronic AG, Munich (DE)

(72) Inventors: Georg Pietsch, Burghausen (DE); Michael Kerstan, Burghausen (DE)

(73) Assignee: Siltronic AG, Munich (DE)

( * ) Notice: Subject to any disclaimer, the term of this patent is extended or adjusted under 35 U.S.C. 154(b) by 0 days.

(21) Appl. No.: 14/184,739

(22) Filed: Feb. 20, 2014

(65) Prior Publication Data

US 2014/0170939 A1 Jun. 19, 2014

Related U.S. Application Data

(62) Division of application No. 13/181,619, filed on Jul. 13, 2011, now Pat. No. 8,911,281.

(30) Foreign Application Priority Data

Jul. 28, 2010 (DE) ..... 10 2010 032 501

(51) Int. Cl.

| | |
|---|---|
| ***B24B 1/00*** | (2006.01) |
| ***B24B 53/017*** | (2012.01) |
| ***B24B 37/08*** | (2012.01) |
| ***B24B 37/28*** | (2012.01) |

(52) U.S. Cl.

CPC ..... *B24B 53/017* (2013.01); *B24B 37/08* (2013.01); *B24B 37/28* (2013.01)

USPC ..... 451/37; 451/36; 451/56

(58) Field of Classification Search

CPC ..... B24B 1/00; B24B 7/17; B24B 7/22; B24B 7/228; B24B 37/08; B24B 37/28; B24B 53/013; B24B 53/017; B24B 53/022

USPC ..... 451/36, 37, 56, 60, 63, 72, 261, 262, 451/270, 271, 443, 53

See application file for complete search history.

(56) References Cited

U.S. PATENT DOCUMENTS

| | | | |
|---|---|---|---|
| 4,433,510 | A | 2/1984 | Katagiri et al. |
| 5,958,794 | A | 9/1999 | Bruxvoort et al. |

(Continued)

FOREIGN PATENT DOCUMENTS

| | | | |
|---|---|---|---|
| DE | 3213252 | A1 | 12/1982 |
| DE | 19937784 | A1 | 2/2001 |

(Continued)

OTHER PUBLICATIONS

Beyer, et al. Innovatives Flachhonen mit kremisch gebundenen Schleif- und Konditionierwerkzeugen- eine neue Systemlösung, 2005, pp. 202-207, Voll. 3, Industrie Diamanten Rundschau IDR 39.

(Continued)

*Primary Examiner* — Timothy V Eley

(74) *Attorney, Agent, or Firm* — Leydig, Voit & Mayer, Ltd.

(57) ABSTRACT

A method for trimming two working layers including bonded abrasive applied on mutually facing sides of an upper and a lower working disk of a grinding apparatus configured for simultaneous double-side processing of flat workpiece includes providing at least one trimming apparatus including a trimming disk, a plurality of trimming bodies and an outer toothing. The upper and lower working disks are rotated. The trimming apparatus is moved between the rotating working disks using a rolling apparatus and the outer toothing on cycloidal paths relative to working layers of the working disks. The working layers and the trimming body are brought into contact so as to release abrasive substances from the trimming bodies and so as to effect material removal from the working layers. The direction of the drives of the grinding apparatus is changed at least twice during trimming.

4 Claims, 4 Drawing Sheets

(56) References Cited

U.S. PATENT DOCUMENTS

| | | | |
|---|---|---|---|
| 6,022,266 | A | 2/2000 | Bullard et al. |
| 6,042,688 | A | 3/2000 | Masumura et al. |
| 6,142,859 | A | 11/2000 | Ross et al. |
| 6,206,765 | B1 | 3/2001 | Sanders et al. |
| 6,752,687 | B2 | 6/2004 | Benning et al. |
| 7,637,802 | B2 | 12/2009 | Yasuoka et al. |
| 2006/0040589 | A1 | 2/2006 | Ising |
| 2008/0014839 | A1 | 1/2008 | Pietsch et al. |
| 2008/0233840 | A1 | 9/2008 | Pietsch et al. |
| 2009/0104852 | A1 | 4/2009 | Pietsch et al. |
| 2009/0305615 | A1 | 12/2009 | Uchiyama |
| 2010/0190418 | A1 | 7/2010 | Yasuoka et al. |
| 2012/0135669 | A1 | 5/2012 | Fletcher et al. |

FOREIGN PATENT DOCUMENTS

| | | | |
|---|---|---|---|
| DE | 102006032455 | A1 | 4/2008 |
| DE | 102007013058 | A1 | 9/2008 |
| DE | 102007049811 | A1 | 4/2009 |
| EP | 1762338 | A1 | 3/2007 |
| EP | 2210707 | A2 | 7/2010 |
| JP | 3251363 | B2 | 3/1994 |
| JP | 1110530 | A | 1/1999 |
| JP | 2000153458 | A | 6/2000 |
| JP | 2001179600 | A | 7/2001 |
| JP | 2005335016 | A | 12/2005 |
| JP | 2007118146 | A | 5/2007 |
| JP | 2008254166 | A | 10/2008 |

OTHER PUBLICATIONS

3M Trizact Diamond Tile 677XA Pad Conditioning Procedure, Technical Application Bulletin, Sep. 2003, pp. 1-4, USA.

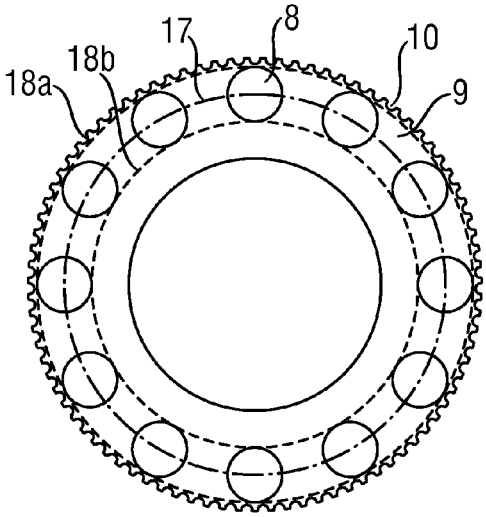
Fig. 4A
Fig. 4B
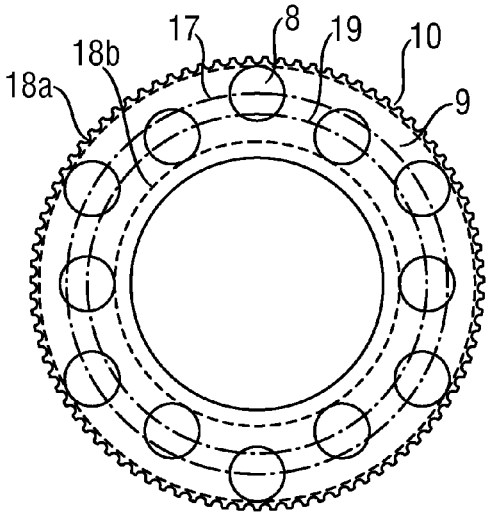
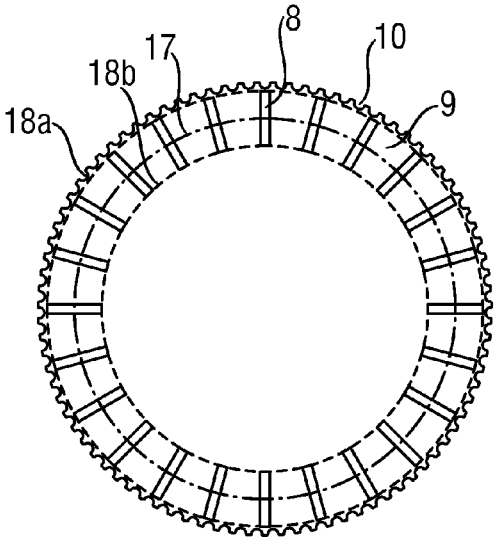
Fig. 4C
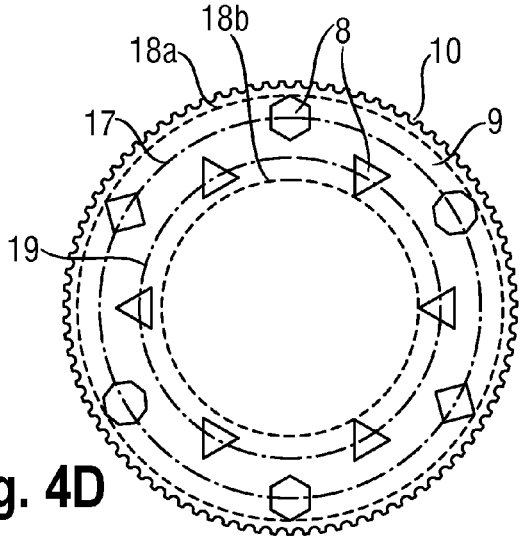
Fig. 4D

METHOD FOR TRIMMING THE WORKING LAYERS OF A DOUBLE-SIDE GRINDING APPARATUS

CROSS REFERENCE TO RELATED APPLICATIONS

This application is a divisional of U.S. patent application Ser. No. 13/181,619, filed Jul. 13, 2011, which claims priority to German Patent Application No. DE 10 2010 032 501.5, filed Jul. 28, 2010. The entire disclosure of both applications is incorporated by reference herein.

FIELD

The present invention relates to a method for trimming two working layers which contain bonded abrasive and are applied on the mutually facing sides of an upper and of a lower working disk of a grinding apparatus for the simultaneous double-side processing of flat workpieces.

BACKGROUND

Electronics, microelectronics and microelectromechanics require as starting materials semiconductor wafers with extreme requirements made of global and local flatness, single-side-referenced flatness (nanotopology), roughness and cleanness. Semiconductor wafers are wafers composed of semiconductor materials such as elemental semiconductors (silicon, germanium), compound semiconductors (for example composed of an element of the third main group of the periodic table such as aluminum, gallium or indium and an element of the fifth main group of the periodic table such as nitrogen, phosphorus or arsenic) or the compounds thereof (for example $Si_{1-x}Ge_x$, $0<x<1$).

In accordance with the prior art, semiconductor wafers are produced by means of a multiplicity of successive process steps which can generally be classified into the following groups:

(a) producing a usually monocrystalline semiconductor rod;
(b) slicing the rod into individual wafers;
(c) mechanical processing;
(d) chemical processing;
(e) chemomechanical processing;
(f) if appropriate additional production of layer structures.

A method designated "planetary pad grinding (PPG)" is known as a particularly advantageous method from the group of mechanical processing steps. The method is described for example in DE102007013058A1, and an apparatus suitable therefor is described for example in DE19937784A1. PPG is a method for the simultaneous double-side grinding of a plurality of semiconductor wafers, wherein each semiconductor wafer lies such that it is freely movable in a cutout in one of a plurality of carriers (guide cages, "insert carriers") caused to rotate by means of a rolling apparatus and is thereby moved on a cycloidal trajectory. The semiconductor wafers are processed in material-removing fashion between two rotating working disks. Each working disk comprises a working layer containing bonded abrasive.

The working layers are present in the form of structured abrasive pads which are fixed on the working layers adhesively, magnetically, in a positively locking manner (for example hook and loop fastener) or by means of vacuum. Suitable working layers in the form of easily exchangeable abrasive pads designed to be self-adhesive on the rear side are described for example in U.S. Pat. No. 5,958,794. The abrasive used in the abrasive pads is preferably diamond.

A similar method is so-called "flat honing" or "fine grinding". In this case, a plurality of semiconductor wafers in the arrangement described above for PPG are guided on the characteristic cycloidal paths between two large rotating working disks. Abrasive grain is fixedly bonded into the working disks, such that the material removal is effected by means of grinding. In the case of flat honing, the abrasive grain can be bonded directly into the surface of the working disk or be present in the form of an areal covering of the working disk by means of a multiplicity of individual abrasive bodies, so-called "pellets", which are mounted onto the working disk (P. Beyer et al., Industrie Diamanten Rundschau IDR 39 (2005) III, page 202).

Over the course of time, in the case of the grinding methods described, the shape of the working layers changes as a result of constant wear, residual grain breaking out from the bonding matrix and fresh grain being uncovered. It is known that the wear proceeds radially non-uniformly across the working disk. Over time, the working layers in this way form a trough-shaped radial profile, such that the resulting shape of the processed semiconductor wafers worsens to an increasing degree over the course of the wear.

Depending on the materials of the grinding tool and of the processed workpieces, moreover, the cutting capacity of the grinding tool can decrease over time. In addition, it is generally necessary for a new grinding tool to be dressed prior to the first use, by means of the bonding matrix being superficially removed and the abrasive grain embedded therein being uncovered.

Therefore, the prior art includes trimming new or used grinding tools. During trimming, suitable trimming tools are moved under pressure and relative to the tools to be trimmed, such that material removal from the working disks or layers takes place. "Trimming" is understood to mean both the reestablishment of the target shape of the grinding tool ("truing"), and the dressing thereof, i.e. the reestablishment of its cutting capacity.

P. Beyer et al., Industrie Diamanten Rundschau IDR 39 (2005) III, page 202 and DE102006032455A1 describe trimming apparatuses comprising trimming rings and an outer toothing which can be inserted into the grinding apparatus like a carrier and can be moved relative to the working disks by the drives of said grinding apparatus.

The trimming rings described in P. Beyer et al., Industrie Diamanten Rundschau IDR 39 (2005) III, page 202 support a working layer having material-removing action, said working layer containing ceramically bonded diamond as abrasive. Said trimming rings are only suitable for dressing the working layers described by P. Beyer et al., which are composed of a multiplicity of sintered (vitreous), metallically bonded or synthetic-resin-bonded abrasive bodies—so-called pellets. Upon the use of the trimming apparatus described therein and of the method specified therein for trimming abrasive pads, however, the specified trimming rings subject the abrasive pad to wear, without attaining an appreciable dressing effect. Moreover, the dressing apparatus specified therein has proved to be unsuitable for producing a defined target shape of the working layer.

"3M™ Trizact™ Diamond Tile 677XA Pad Conditioning Procedure Rev. A", 3M Technical Application Bulletin, September 2003, specifies a method for the initial dressing ("break-in") of a working layer containing bonded abrasive, in which thin, circular abrasive films are stuck to steel disks. The steel disks are toothed and roll on inner and outer pin wheels of the grinding apparatus. Material removal from the working layer is achieved by relative movement between steel disk and working disks under pressure and with addition of water. This method is actually suitable for subsequently dressing working layers that have become blunt, or for providing newly applied working layers, on the surface of which abrasive has not yet been exposed and which therefore do not yet exhibit a cutting effect, with initial dressing for providing a first cutting effect. The method is extremely impracticable, however, since the thin abrasive films applied by adhesive bonding are usually worn within a single use, which results in an extremely unstable dressing process with fluctuating dressing results. Moreover, the abrasive films specified proved to be unsuitable for obtaining trimming of the working layer to form a defined target shape—preferably plane-parallel surfaces of the two working layers.

DE102006032455A1 states that the trimming is advantageously effected predominantly using free grain. The trimming rings disclosed therein continually release abrasive as a result of constant wear, said abrasive ultimately providing for the necessary material removal from the working layers. It has been found, however, that targeted dressing and, in particular, targeted production of a defined target shape of the working layers are not possible using trimming rings of this type.

In addition to the abovementioned specific disadvantages of the above methods, the following problems generally occur during trimming in accordance with the prior art:

The trimming leads to a direction dependence of the grinding behavior of the dressed working layers. It has been observed, for example, that some abrasive pads used as a working layer already have a preferred direction in a manner governed by production. The fashioning of a preferred direction also occurs as a result of the use and as a result of the trimming itself. Preferred direction should be understood here to mean that the abrasive pad, with identical pressure, identical rotational speeds and rotational speed ratios ("kinematics") of the drives, identical shape of the working gap between the working disks and identical cooling lubrication, achieves a higher material removal rate in one direction than in the case of operation with rotational speeds that are in each case exactly the opposite in terms of sign, but identical rotational speed ratios and identical pressure, gap shape and cooling lubrication. The directional dependence of the grinding behavior has the effect that only very limited rotational speed combinations can be used for the drives of the grinding apparatus.

In addition, during operation in only one direction, the thin carriers for the semiconductor wafers only ever roll in one direction and wear non-uniformly and hence more rapidly by comparison with more uniform loading during operation with a changing direction. This reduces the usable life of the expensive carriers and makes the method uneconomic.

The working layer, too, constantly alters its properties during grinding operation only in one direction. Changing operation with directions of rotation of the drives of the grinding apparatus that alternate from pass to pass or at least from pass block to pass block counteracts that and thus permits more uniform operating conditions.

If the working layers have a preferred direction, however, operation with alternating drive directions is not possible since thickness, shape, removal rate and surface roughness of the workpieces would then constantly alternate, constantly changing heat inputs would make extremely stringent requirements of the regulation of a desirably uniform processing process and, moreover, the working layers would be worn differently and would have to be frequently trimmed or dressed, which necessitates additional process interruptions that adversely affect the economic viability of the method.

These restrictions make the otherwise advantageous PPG method and the measures known in the prior art for keeping constant the shape and cutting behavior of the working layers unsuitable for producing semiconductor wafers of high flatness for particularly demanding applications.

When the working layers are used for grinding workpieces such as semiconductor wafers, for example, the upper and the lower working layers can be subjected to wear of differing magnitudes. The known trimming methods are not able to take account of this different wear, for which reason generally more material than necessary is removed from one of the working layers during trimming. This unnecessary material removal has the effect that the working layers have to be changed more frequently than necessary.

The toothed rings or pin wheels of the rolling apparatus of the grinding machine have a small height coordinated with the thickness of the workpieces usually processed, and are also height-adjustable only to a small extent. Consequently, it is not possible to use trimming bodies of any desired thickness which lead to a height of corresponding magnitude for the trimming apparatuses. This has the effect that the trimming apparatuses or at least the trimming bodies have to be frequently changed.

FIG. 5 shows the essential elements of an apparatus according to the prior art whose working layers can be trimmed by means of the methods according to the invention. The illustration shows the basic schematic diagram of a two-disk machine for processing disk-shaped workpieces such as semiconductor wafers, as is disclosed for example in DE19937784A1, in perspective view. An apparatus of this type has an upper working disk 51 and a lower working disk 52 with collinear rotational axes 53 and with substantially plane-parallel arrangement of the working surfaces of the working disks with respect to one another. According to the prior art, the working disks 51 and 52 are fabricated from gray cast iron, cast stainless steel, ceramic, composite materials or the like. The working surfaces are uncoated or provided a coating made of, for example, stainless steel or ceramic, etc. The upper working disk contains numerous holes 54 through which a cooling lubricant (e.g. water) can be fed to the working gap 55. The apparatus is provided with a rolling apparatus for carriers 56. The rolling apparatus consists of an inner drive ring 57 and outer drive ring 58. The carriers 56 each have at least one cutout which can receive a workpiece 59 to be processed, for example a semiconductor wafer. The rolling apparatus can be embodied for example as pin gearing, as involute gearing or as some other customary type of gearing. Upper working disk 51 and lower working disk 52 and inner drive ring 57 and outer drive ring 58 are driven at rotational speeds $n_o$, $n_u$, $n_i$ and $n_a$ about substantially identical axes 53. In this case, "substantially" means that the offset of the axes of rotation of the individual drives relative to the central axis of all the drives amount to less than one per mille of the diameter of the working disks, and the tilting of the axes with respect to one another amounts to less than 2°. A cardanic suspension of the upper working disk 51 compensates for any residual tilting of the axes, such that the mutually facing working surfaces of the working disks can be moved with azimuthally identically distributed force and without wobbling movement relative to one another.

Each working disk 51, 52 supports a working layer 60, 61 on its working surface. The working layers are preferably abrasive pads.

An "abrasive pad" is understood hereinafter to mean a working layer composed of at least three layers, comprising a closed, continuous or interrupted useful layer, facing away from the working disk, in the form of a smooth or structured film, a woven fabric, felt, knitted fabric or individual elements, which contains bonded abrasive and has a useful thickness of more than one abrasive grain layer and at least one part of which makes direct contact with the workpieces to be processed and thereby brings about material removal;

a central closed, or at least continuous support layer in the form of a smooth or structured film, a woven fabric, knitted fabric or felt, which supports the useful layer and connects all the elements of the useful layer to form a continuous unit; and a closed, continuous or interrupted mounting layer, which faces the working disk and, over the period of the useable life of the useful layer or a shorter period, determined by the user, forms a force-locking or positively locking composite assembly with the working disk of the grinding apparatus, for example by means of vacuum (sealed mounting layer), magnetically (mounting layer contains a ferromagnetic layer), hook and loop fastener (mounting layer and working disk contain "hook" and "loop"), adhesive bonding (mounting layer is provided with self-adhesive or activatable adhesive layer), etc. The abrasive pad is elastic and can be detached from the working disk by peeling movement. The abrasive pad can, particularly when covering particularly large working disks, be subdivided into up to eight segments, four segments for each working platen, which can be removed or mounted individually to form a gap-free parquetting of the working disk area to be covered.

Suitable abrasive pads are described for example in U.S. Pat. No. 5,958,794. The abrasive pads are preferably structured in the form of small regular units. Preferably, these units consist of regularly arranged "islands" (uniformly elevated regions) and "trenches" (recessed regions). In this case, the islands become engaged with the workpieces and thus bring about material removal. The trenches feed in cooling lubricant and carry away resulting grinding slurry. The absolute size of islands and trenches and the area ratio thereof (supporting area proportion of the working layer) constitute crucial features for the material-removing function of the working layer. The islands of one abrasive pad that is preferably used (Trizact™ Diamond Tile 677XA or 677XAEL from 3M Company) have for example a square shape having an edge length of a few millimeters and are separated by trenches having a width of approximately one millimeter, thus resulting in a supporting area proportion of between 50% and 60%.

The abrasive used in the abrasive pads is preferably diamond. However, other hard substances are likewise suitable (for example cubic boron nitride (CBN), boron carbide ($B_4C$), silicon carbide (SiC, "carborundum"), aluminum oxide ($Al_2O_3$, "corundum"), zirconium oxide ($ZrO_2$), silicon dioxide ($SiO_2$, "quartz"), cerium oxide ($CeO_2$) and many others.

However, the abrasive grain can also be directly bonded into the surface of the working disk or be present in the form of an areal covering of the working disk by means of a multiplicity of individual grinding bodies, so-called "pellets", which are mounted onto the working disk.

The working gap formed between the working layers 60 and 61 fixed on the upper working disk 51 and lower working disk 52, within which gap the semiconductor wafers are processed, is designated by 55 in FIG. 1.

SUMMARY

In an embodiment, the present invention provides a method for trimming two working layers including bonded abrasive applied on mutually facing sides of an upper and a lower working disk of a grinding apparatus configured for simultaneous double-side processing of flat workpiece. The method includes providing at least one trimming apparatus including a trimming disk, a plurality of trimming bodies and an outer toothing. The upper and lower working disks are rotated. The trimming apparatus is moved between the rotating working disks using a rolling apparatus and the outer toothing on cycloidal paths relative to working layers of the working disks. The working layers and the trimming body are brought into contact so as to release abrasive substances from the trimming bodies and so as to effect material removal from the working layers. The direction of the drives of the grinding apparatus is changed at least twice during trimming

BRIEF DESCRIPTION OF THE FIGURES

Embodiments of the present invention are described in more detail below with reference to the drawings, in which:

FIG. 4A shows an embodiment of a trimming apparatus suitable for carrying out the third method according to the invention, with trimming bodies arranged on one pitch circle.

FIG. 4B shows an embodiment of a trimming apparatus suitable for carrying out the third method according to the invention, with trimming bodies arranged on a plurality of pitch circles.

FIG. 4C shows an embodiment of a trimming apparatus suitable for carrying out the third method according to the invention, with trimming bodies shaped in elongate fashion.

FIG. 4D shows an embodiment of a trimming apparatus suitable for carrying out the third method according to the invention, with trimming bodies having different shapes arranged on a plurality of pitch circles.

DETAILED DESCRIPTION

Figure 1A:
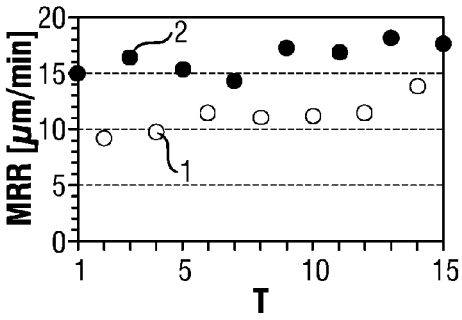
FIG. 1A shows, as a comparative example, the material removal rates from semiconductor wafers which are obtained after trimming, not according to the invention, in grinding processing passes with a direction of rotation of all the drives that alternates from pass to pass.

Consequently, the present invention can include the following aspects:

A first aspect is, during trimming, to avoid the production of a preferred direction of the working layer and to reliably eliminate any preferred direction already present.

A second aspect is to improve the flatness, achievable by means of the trimming, of the working layers and thus of the working gap.

A third aspect is to take account of non-uniform wear of the upper and of the lower working layer during trimming such that only as much material as necessary is removed from both working layers during trimming A fourth aspect is to enable longer use of the trimming tools.

The first aspect is achieved by means of a method for trimming two working layers which contain bonded abrasive and which are applied on the mutually facing sides of an upper and of a lower working disk of a grinding apparatus for the simultaneous double-side processing of flat workpieces, by means of at least one carrier having an outer toothing, wherein the at least one carrier is moved between the rotating working disks by means of a rolling apparatus and the outer toothing under pressure on cycloidal paths relative to the working layers, wherein loose abrasive is added to the working gap formed between the working layers, in which working gap the carriers without workpieces inserted therein move, and material removal from the working layers is thereby effected.

The first aspect is likewise achieved by means of a second described embodiment of a method for trimming two working layers which contain bonded abrasive and are applied on the mutually facing sides of an upper and of a lower working disk of a grinding apparatus for the simultaneous double-side processing of flat workpieces, by means of at least one trimming apparatus, comprising a trimming disk, a plurality of trimming bodies and an outer toothing, wherein the at least one trimming apparatus is moved between the rotating working disks by means of a rolling apparatus and the outer toothing under pressure and with addition of a cooling lubricant, which contains no substances with abrasive action, on cycloidal paths relative to the working layers, wherein the trimming bodies release abrasive substances upon contact with the working layers and thus effect material removal from the working layers by means of loose grain, wherein the direction of rotation of all the drives of the grinding apparatus is changed at least twice during the trimming or dressing.

The second aspect is achieved by means of a third described method for trimming two working layers which contain bonded abrasive and are applied on the mutually facing sides of an upper and of a lower working disk of a grinding apparatus for the simultaneous double-side processing of flat workpieces, by means of at least one trimming apparatus, comprising a trimming disk, a plurality of trimming bodies and an outer toothing, wherein the at least one trimming apparatus is moved between the rotating working disks by means of a rolling apparatus and the outer toothing under pressure and with addition of a cooling lubricant, which contains no substances with abrasive action, on cycloidal paths relative to the working layers, wherein the trimming bodies release abrasive substances upon contact with the working layers and thus effect material removal from the working layers by means of loose grain, wherein at least 80% of the area of the trimming bodies which comes into contact with the working layers is arranged within a ring-shaped region on the trimming disk, wherein the width of said ring-shaped region is between 1% and 25% of the diameter of the trimming disk, and wherein the area of the trimming bodies which comes into contact with the working layers occupies 20% to 90% of the total area of the ring-shaped region.

The second aspect is likewise achieved by means of a trimming apparatus for trimming two working layers which contain bonded abrasive and are applied on the mutually facing sides of an upper and of a lower working disk of a grinding apparatus for the simultaneous double-sided processing of flat workpieces, comprising a trimming disk, a plurality of trimming bodies and an outer toothing, wherein the trimming bodies release abrasive substances upon contact with the working layers and can thus effect material removal from the working layers by means of loose grain, wherein at least 80% of the area of the trimming bodies which comes into contact with the working layers is arranged within a ring-shaped region on the trimming disk, wherein the width of said ring-shaped region is between 1% and 25% of the diameter of the trimming disk, and wherein the area of the trimming bodies which comes into contact with the working layers occupies 20% to 90% of the total area of the ring-shaped region.

The third aspect is achieved by means of a fourth described method for trimming two working layers which contain bonded abrasive and are applied on the mutually facing sides of an upper and of a lower working disk of a grinding apparatus for the simultaneous double-side processing of flat workpieces, by means of at least one trimming apparatus, comprising a trimming disk, a plurality of trimming bodies and an outer toothing, wherein the at least one trimming apparatus is moved between the rotating working disks by means of a rolling apparatus and the outer toothing under pressure and with addition of a cooling lubricant, which contains no substances with abrasive action, on cycloidal paths relative to the working layers, wherein the trimming bodies release abrasive substances upon contact with the working layers and thus effect material removal from the working layers by means of loose grain, wherein firstly the radial shape profile of the two working layers is measured and the minimum material removal required for reestablishing a flat surface is determined therefrom for each of the two working layers, and wherein the trimming process is then carried out, wherein the removal rates from the upper and the lower working layer are set by means of a suitable choice of the flow rate of the cooling lubricant and also the pressure with which the upper working disk is pressed against the lower working disk during trimming such that their ratio corresponds to the ratio of the minimum material removals.

The fourth aspect is achieved by means of a fifth described method for trimming two working layers which contain bonded abrasive and are applied on the mutually facing sides of an upper and of a lower working disk of a grinding apparatus for the simultaneous double-side processing of flat workpieces, by means of at least one trimming apparatus, comprising a trimming disk, a plurality of trimming bodies and an outer toothing, wherein the at least one trimming apparatus is moved between the rotating working disks by means of a rolling apparatus and the outer toothing under pressure and with addition of a cooling lubricant, which contains no substances with abrasive action, on cycloidal paths relative to the working layers, wherein the trimming bodies release abrasive substances upon contact with the working layers and thus effect material removal from the working layers by means of loose grain, wherein the outer toothing is height-adjustable relative to the trimming disk.

The fourth aspect is likewise achieved by means of a trimming apparatus for trimming two working layers which contain bonded abrasive and are applied on the mutually facing sides of an upper and of a lower working disk of a grinding apparatus for the simultaneous double-sided processing of flat workpieces, comprising a trimming disk, a plurality of trimming bodies and an outer toothing, wherein the trimming bodies release abrasive substances upon contact with the working layers and can thus effect material removal from the working layers by means of loose grain, wherein the outer toothing is height-adjustable relative to the trimming disk.

Embodiments of methods according to the invention are suitable, in particular, for trimming abrasive pads. The expression "abrasive pad" is defined further below in the context of the description of the apparatus.

In the first described embodiment of a method according to the invention, loose abrasive (also referred to as "lapping grain") is added to the working gap formed between the working layers, in which working gap the carriers move, and material removal from the working layers is thereby effected. Preferably, a liquid, for example water, is additionally added. No workpieces are inserted into the carriers in this case.

Specifically, it has been found that the working layers, upon losing their cutting capacity, can be dressed again in a simple manner by a procedure in which the carriers, which otherwise carry the semiconductor wafers during the grinding processing, are left in the grinding apparatus, some loose lapping grain and, if appropriate, some liquid are added and the carriers are then moved by means of the rolling apparatus under pressure on cycloidal paths relative to the working layers. This functions very well particularly when at least part of the surface with which the carriers come into contact with the working layers consists of an elastic material.

Carriers preferably used in the PPG method are described in DE102007013058A1. They consist of a steel core, for example, which brings about the necessary stability during the rolling movement under load, and a coating made of a softer but very tough and abrasion-resistant material, for example a polyurethane, which forms protection against wear caused by the frictional, cutting, shearing and peeling forces of the abrasive grain bonded in the abrasive pad, said forces having an effect during processing. It has now been found that loose lapping grain introduced into the gap between carrier and working layer settles partly and temporarily in the elastic coating of the carrier. As a result, the carriers entrain the lapping grain over the working layer and release it again uniformly, such that material removal from the working layer is brought about by relative movement between the carrier with the lapping grain thus entrained in a semisolid fashion and the working layer.

Investigations with carriers having a hard, inelastic surface known from lapping or double-side polishing have shown that loose lapping grain is immediately stripped away from their smooth surface owing to the large edge length and small extent of the islands of the abrasive pads used (as described above) and is carried away without effect via the trenches. Only the use of carriers of which at least one part of the surface that becomes engaged with the abrasive pad consists of a soft, compliant material has a sufficient "driving effect" on the lapping grain in order to guide the latter over the surface of the islands of the abrasive pad that becomes engaged with the workpieces and thereby to bring about material removal from them.

It has been observed that it suffices to add lapping grain once before the beginning of this dressing. It has been found that the lapping grain, owing to the soft anti-wear layers of the carriers, remains long enough for dressing of the working layers in the working gap formed between the working layers and does not constantly have to be replenished. As a result, the cooling lubricant feeds in the upper working disk of the grinding apparatus remain free of lapping grain, and, after the working layers have been dressed in this way, the grinding apparatus can easily be purged and immediately used again for the processing of semiconductor wafers in the next pass, without production of undesired scratches as a result of lapping grain that has remained in the grinding apparatus or lapping grain residues released by purging in an uncontrolled manner from the cooling lubricant feeds on the semiconductor wafers.

The hardness of the described parts of the surface of the carrier is preferably between 50 Shore A and 90 Shore D. Particularly preferably, the hardness is between 60 Shore A and 95 Shore A. The lapping grain used preferably has an average grain size of the order of magnitude of the abrasive grain of the working layers that brings about the material removal from the semiconductor wafers. The abrasive pads Trizact™ Diamond Tile 677XA or 677XAEL from 3M Company have grain sizes of between 1 and 12 μm, depending on the specification. The lapping grain preferably used for carrying out the first-described method according to the invention has a grain size of between 2 and 15 μm. Suitable lapping grain consists of aluminum oxide (corundum), silicon carbide, boron nitride, cubic boron nitride, boron carbide, zirconium oxide and mixtures thereof.

It has been found that this dressing only brings about very little material removal from the working layers. That is advantageous for purely dressing the working layers because firstly the shape of the working layers is not changed as a result, and secondly, moreover, an unnecessarily large amount of material is not removed from the expensive working layers, preferably containing diamond. Despite the small material removal, the dressing effect proved to be good. In particular, the abrasive pad dressed in this way had no or only a very small residual preferred direction, that is to say yielded identical or virtually identical semiconductor material removal rates in the subsequent grinding processing of semiconductor wafers in both directions of rotation. This method proved to be very well suited to dressing. A change in shape ("truing") cannot be carried out by this means. The working layers are too robust for this.

Finally, it was found that, during dressing with carriers and loose lapping grain, the coating of the carriers was subjected to higher wear than in the case of their use as guide cages during the grinding processing of semiconductor wafers. As a result, a coating of the carriers that was initially too thick or non-uniform, for example, was able to be thinned or leveled without the need to carry out for this purpose a large number of passes with semiconductor wafers which should have been rejected as non-dimensionally accurate rejects. (Direct thinning by grinding or leveling of non-uniformly coated carriers by movement between the working layers under pressure and without addition of lapping grain does not work: it was found that the working layers thereby become blunt very rapidly and material removal no longer takes place.)

In the second described embodiment of a method according to the invention, the working layers are trimmed using a trimming apparatus which has trimming bodies having bonded abrasive which release abrasive during the trimming. The trimming takes place with repeated reversal, i.e. reversal at least twice, of the direction of all the drives (upper and lower working disks and outer and inner drive rings) of the grinding apparatus.

Embodiments of the invention are based on the observation that the removal behavior of many working layers is influenced by the previous use thereof. It was observed that the working layer has, with regard to its grinding behavior, a more or less highly pronounced "memory" of its pretreatment, to be precise both with regard to the direction of preceding trimming and with regard to the direction of the preceding grinding operation. Some working layers even have a preferred direction in a manner governed by production.

In the context of the investigations leading to the present invention, it had emerged that, in particular, the direction of the last trimming process crucially influences the preferred direction of the grinding behavior of the working layers. It had furthermore been found that the difference between the material removal rate during operation in the preferred direction and that during operation precisely counter to the preferred direction became all the greater, the longer and the greater the material removal with which the trimming was effected. It had likewise been found that the manifestation of a preferred direction quantified in this way became all the greater, the longer the working layers had previously been used in one direction and the greater the amount of associated pad wear involved in such use.

By virtue of the reversal in direction of all the drives at least twice, the material removal per partial step carried out in one direction and hence the manifestation of a preferred direction are reduced.

Preferably, during each subsequent partial step of the trimming process, that is to say from direction reversal to direction reversal, less and less material is always removed from the working layers than in the preceding partial step. This can be achieved by reducing the duration of such a partial step, by decreasing the pressure during trimming or by reducing the path speed (shortened length of the trajectory during a partial trimming process).

Particularly preferably, the partial steps are progressively shortened such that, during the last partial step, the thickness of the working layers decreases by less than the average diameter of the abrasive grain bonded in the working layers.

Particularly preferably, the material removal from each of the working layers during the last partial step is between 10% and 100% of the average grain size of the abrasive grain bonded in the working layers. 100% thus corresponds on average to precisely one "grain layer" of the working layer. It was found that a further reduction of the last removal below 10% of the average grain size affords no further advantage or any possible advantage no longer justifies the disadvantage of the increased time expenditure. It was likewise found that material removal of more than one grain layer often still leaves a preferred direction.

If the grain distribution and mixture of the working layer is not known exactly, the average grain size can be determined in a simple manner. For this purpose, the grain is extracted from the bonding matrix mechanically (by comminution), chemically (dissolution or separation of bonding matrix and fillers) or thermally (separation by melting) or by a combination of these methods, and is applied in a thin layer to a specimen slide and a micrograph is produced. The grain sizes that can be discerned on the micrograph are then counted using a set of shape stencils. The average grain size and any deviations from normalized standard grain size distributions can immediately be read from the resultant histogram of the grain size distribution. The accuracy with which the grain sizes can be determined even using simple laboratory means in the simple manner specified is sufficient in any event for carrying out the trimming methods according to the invention.

The effect of the second described embodiment of a method according to the invention is elucidated below on the basis of an example and a comparative example (FIG. 1). In this case, identical abrasive pads were trimmed once according to an embodiment of the invention (example) and once in a manner not according to the invention (comparative example).

In the example, during trimming, the direction of all the drives was reversed seven times, that is to say that a total of eight trimming passes were carried out. In this case, the material removal was additionally reduced upon every second trimming pass. In the example, this progressive removal reduction was effected by repeatedly shortening the duration of an individual trimming pass from initially one minute to finally five seconds. Pressure and rotational speeds were kept the same for all the individual trimming passes. Initially, the working layer, as determined by pad thickness measurements, is in this case removed by up to 10 μm; in the last pass, the removal was below the measurement limit (1 μm).

In the comparative example, the abrasive pad was trimmed in the same way as described for the example, but without the reversal of the direction of the drives.

The abrasive pads trimmed according to the embodiment of the invention and not according to the invention were subsequently used for in each case 15 successive grinding passes. 15 wire-sawn monocrystalline silicon wafers having the orientation (100) and having a diameter of 300 mm were processed during each grinding pass. Five carriers were each equipped with three silicon wafers. FIG. 1 shows, on the y-axis, the material removal rate MRR obtained in this case in μm/min. The time T in units of successive PPG grinding passes carried out is indicated on the x-axis. Each data point therefore corresponds to a PPG pass. From one grinding pass to the next, the direction of rotation of all the drives of the grinding apparatus (upper and lower working disks, inner and outer drive rings of the rolling apparatus for the carriers) was in each case exactly inverted (change of sign for all rotational speeds). The unfilled symbols 1 and 3*a* therefore all correspond to an identical rotational speed configuration of the drives, and the filled symbols 2 and 3*b* correspond to such a configuration with in each case exactly inverted directions of rotation. Apart from the reversal of the direction of rotation, all of the grinding passes in the example and the comparative example were carried out in an identical manner. Example and comparative example differ only in the above-described manner of trimming the abrasive pads before the latter are used.

Figure 1B:
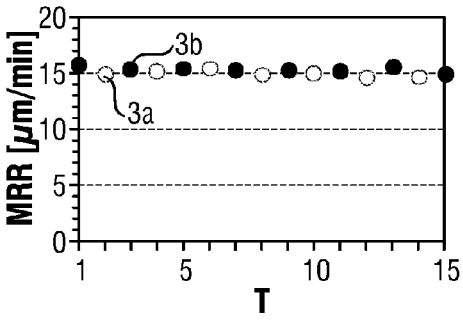
FIG. 1B shows the material removal rates from semiconductor wafers which are obtained after trimming according to the second method according to the invention in grinding processing passes with a direction of rotation of all the drives that alternates from pass to pass.

FIG. 1B shows the result of the example with the abrasive pads trimmed according to the invention: It is evident that the removal rates obtained are virtually identical for both directions of rotation. It is not possible to discern any "preferred direction" of one direction of rotation or the other, either governed by trimming or governed by abrasive pad production.

FIG. 1A shows the result of the comparative example with the abrasive pads trimmed not according to the invention. A pronounced preferred direction of the abrasive pad is clearly discernible: All the removal rates 2 in one direction are significantly higher than the removal rates 1 in the corresponding opposite direction of all the drives. The difference in removal rates between one direction and the other is up to almost 100% (relative to the lower removal rate 1).

A PPG process of this type is very unstable. A PPG apparatus generally has an apparatus for measuring the instantaneous thickness of the semiconductive wafers during processing, which ends the processing upon the target thickness being attained (end point switch-off). The end point switch-off is realized for example by means of eddy current sensors incorporated in the surface of one of the working disks, which sensors determine the distance between said surface and the surface of the other working disk. An example of suitable sensors, arrangements and measuring processes is described in DE3213252A1.

Owing to the essential run-on of the drives (braking of the working disk), an unavoidable "subsequent grinding" of the semiconductor wafers inevitably occurs after the target thickness has been attained, even with a rapidly reduced working pressure. Therefore, after the actual end of processing, the thickness of the semiconductor wafers is somewhat smaller than the final thickness determined by the measuring apparatus. Owing to the different removal rates during the operation of the grinding apparatus in one direction compared with operation in the other direction (symbols 2 and 1, respectively, in FIG. 1A), said subsequent grinding differs greatly for the two directions in this comparative example not according to the invention. Semiconductor wafers from different processing passes therefore have different actual final thicknesses. Moreover, the geometry (plane-parallelism) of the semiconductor wafers fluctuates greatly from one pass to the next since the heat inputs (grinding work, machining work) fluctuate on account of the different removal rates. This leads to an unstable process with resultant semiconductor wafers which are unsuitable for demanding applications.

When the trimming process is carried out according to embodiments of the invention with repeated reversal of the direction of all the drives, these problems do not occur here, as clearly evident from FIG. 1B.

A trimming apparatus comprising trimming bodies is used in the third described embodiment of a method according to the invention. The trimming bodies are at least predominantly arranged within a ring-shaped region on the trimming disk, the width of said ring-shaped region being between 1% and 25% and preferably between 3.5% and 14% of the pitch circle diameter of the trimming disk. At least 80% and preferably at least 90% of the area of the trimming bodies which comes into contact with the working layers is situated within said ring-shaped region. The area of the trimming bodies which comes into contact with the working layers corresponds to 20% to 90%, preferably 40% to 80%, of the total area of the ring-shaped region.

The choice of the dimension figures specified resulted from the following considerations and observations in the course of experiments concerning the dimensioning of a trimming apparatus suitable according to the invention:

Firstly, one or a plurality of the trimming bodies fitted on the trimming disk together should, in the course of the rolling movement of the trimming apparatus between the pin wheels of the grinding apparatus, sweep over the entire ring-shaped region of the working layer which comes into contact with workpieces during grinding in order to bring about material removal and hence trimming of the entire used region of the working layer. This defines the preferred external diameter of the ring-shaped covering with trimming bodies.

Secondly, the investigations showed that trimming of the working layers to a defined target shape—here preferably a highest possible degree of plane-parallelism of those surfaces of the working layers which become engaged with the workpieces with respect to one another—can be obtained only if the ring-shaped region with the trimming bodies has at most the width specified above. In the case of an arrangement with grinding bodies even further in the center of the trimming disk than is provided according to the invention, and in particular with a substantially uniformly distributed complete covering of the available area of the trimming disk with trimming bodies, it was not possible to obtain good plane-parallelism of the working layers.

In this case, it was found that it suffices if the trimming bodies are arranged substantially within the ring widths specified, that is to say that individual trimming bodies can also be fitted further toward the inside, provided that the plurality of the trimming bodies is fitted within the dimensions specified. However, arranging individual trimming bodies outside the ring width specified does not afford an advantage; rather it was found that a poorer trimming effect is obtained with an increasing number of trimming bodies arranged further toward the inside. The method then still functions, but with a poorer result, for which reason the exclusive arrangement in the ring region specified is preferred.

It was found, in particular, that one or a plurality of trimming bodies can be arranged with part of the area thereof or completely by together up to 20% of the total area of all the trimming bodies of the trimming apparatus that comes into contact with the working disk outside the ring region described, without any disadvantage being observed in the trimming of the working layer to form a defined target shape. The trimming result of an arrangement with together up to 10% of the trimming body area outside the ring region is indistinguishable from that of an arrangement of the trimming bodies completely within the ring region according to the invention. If between 10% and 20% of the trimming body area lies outside the ring region, although the trimming result is distinguishable from that of trimming with trimming bodies arranged completely within the ring region, a target shape of the working layer that is well defined according to the invention can still be achieved, for which reason an arrangement of this type is still according to the invention. If more than 20% of the trimming body area lies outside the claimed ring region, however, a target shape that is well defined according to the invention can no longer be achieved, for which reason an arrangement of this type is then no longer according to the invention.

It should be clarified that the expression "lying within the ring-shaped region" means that the relevant trimming bodies are situated on the area of the ring-shaped region. A position of a trimming body further toward the center of the trimming disk is referred to here as "outside the ring-shaped region".

FIG. 4 illustrates the apparatus used for carrying out the third described embodiment of a method according to the invention. FIG. 4A shows a trimming apparatus according to an embodiment of the invention, comprising trimming bodies 8 on a trimming disk 9 with a toothing ("outer toothing") 10 fitted to the circumference of the trimming disk, and corresponding to the rolling apparatus of the PPG grinding apparatus. In the example shown here the grinding bodies 8 are arranged uniformly concentrically around the trimming disk 9 on a pitch circle 17. The width of the ring-shaped arrangement of the trimming bodies is described by the ring width between inner envelope curve 18*b* and outer envelope curve 18*a*. In the example shown, the ring width is exactly identical to the diameter of the trimming bodies 8 since all the trimming bodies are arranged on a pitch circle 17. FIG. 4B shows another exemplary embodiment according to the invention, with identical trimming bodies 8 on two pitch circles 17 and 19. The width of the ring-shaped arrangement of the trimming bodies 8, that is to say the ring width between inner envelope curve 18*b* and outer envelope curve 18*a*, is greater here than the diameter of an individual trimming body 8. The shape of the trimming bodies 8 for carrying out the second described embodiment of a method according to the invention is not restricted. FIG. 4C shows, by way of example, trimming bodies 8 having a rectangular cross section (in an exemplary arrangement on a pitch circle); FIG. 4D shows triangular, quadrangular, hexagonal and octagonal grinding bodies 8 (in an exemplary arrangement on two pitch circles).

Preference is given to trimming bodies 8 having a circular or ring-shaped cross section (as illustrated in FIGS. 4A and B), that is to say trimming bodies of cylindrical or hollow-cylindrical shape. It was found that these can be produced particularly reproducibly and with readily predictable shrinkage during the sintering process and are therefore dimensionally accurate. This is desirable particularly when, after wear of the trimming bodies, the residues thereof are removed from the trimming disk and replaced by new trimming bodies, preferably having identical dimensions and properties, such that the entire trimming process remains unchanged even after the trimming tool has been changed. It was furthermore found that for the effective utilization of the abrasive grain bonded in the trimming bodies a maximum ratio of area content (from which the material-removing grain is released) to edge length of the trimming bodies (via which the grain leaves the contact zone between trimming body and working layer and thus becomes ineffective) is preferred. This results in a preferably cylindrical shape of the trimming bodies. A hollow-cylindrical shape (cylinder having a concentric hole) likewise still approximately meets this requirement. The hole 20 (FIG. 3) in the center can advantageously be used in order, when the trimming bodies 8 are fixed on the trimming disk 9, which is effected by adhesive bonding, for example, by means of centering pins through the hole 20 and corresponding holes in the trimming disk 9, to prevent the trimming bodies 8 from slipping during the fixing process.

In addition, cylindrical or hollow-cylindrical trimming bodies have only a curved edge and no sharp corners. Specifically, it was found that trimming bodies having corners, that is to say those having a polygonal cross section, but in particular triangles, exhibit at the corners in some instances an increased tendency toward spalling of relatively large pieces of the trimming body material. That is undesirable because the working layer is thereby damaged and in the case of the use of structured working layers such as are described as "tiled" abrasive pads in U.S. Pat. No. 5,958,794, for example, even entire "tiles" can be torn away. However, trimming bodies having a polygonal base area can likewise be used efficiently, particularly those having six or more corners and if the latter have angles of always more than 90°, that is to say preferably regular polygons.

The covering of the ring-shaped zone on the trimming disk with annulus segments that almost produce a closed annulus, as described, for example in P. Beyer et al., Industrie Diamanten Rundschau IDR 39 (2005) III, page 202, is not advantageous. It was found that the force applied to the trimming body during the trimming process is then distributed over an excessively large area, such that too little abrasive is released and the desired trimming effect is not achieved with a low bearing force. The bearing force also cannot be increased arbitrarily in order to counteract the distribution over a large area. Specifically, it was found that the working layer, which generally always has a certain elasticity (e.g. on account of a synthetic resin bonding or owing to soft fillers), is then elastically deformed to an excessively great extent and good flatness cannot be obtained. Moreover, trimming with only little addition of water is desirable. This results in friction, which is desirable in order to release grain from the trimming bodies. If said friction becomes excessively high on account of excessively high pressure forces, the machine drives can be overloaded or severe rattling is produced by "stick and slip" of the working layers on the trimming apparatuses. In some instances, the forces become so great and irregular that trimming bodies were torn away from the trimming disk in this case. The desired flatness cannot be produced in this way. This effect of disadvantageously large, connected trimming bodies is intensified by dry running on account of the oversized contact area.

It was likewise found that choosing too few, in particular small, trimming bodies is unfavorable. In that case, even at the low bearing forces which are at least necessary in order to ensure wobble-free movement of the cardanically mounted solid upper working disk, such a high pressure is then allotted to the few trimming bodies that too much grain is released. Alongside obvious economic disadvantages, this proved to be disadvantageous insofar as an excessively thick film of free grain arises between trimming bodies and working layer. As a result, the highly flat surface of the trimming bodies, which surface is always re-forming as a result of constant wear and is self-leveling owing to the kinematic properties of the rolling system (planetary gearing) can no longer be mapped directly onto the working layer. With an excessively thick grain film, the working layers do not attain the desirably high measure of parallelism with respect to one another.

Therefore, a degree of filling of between 20% and 90% is preferred. Degree of filling should be understood to mean the ratio of the total area of the trimming bodies applied on the trimming disk which has contact with the working layer during the trimming process to the area of the annulus within which the trimming bodies are arranged. A degree of filling of between 40% and 80% is particularly preferred.

Preferably, the degree of filling of the side of the trimming disk whose trimming bodies become engaged with the upper working layer during the trimming process is exactly equal to the degree of filling of the side of the trimming disk whose trimming bodies become engaged with the lower working layer during the trimming process. Particularly preferably, it is even the case that trimming bodies respectively identical in terms of shape and area for upper and lower working layers are respectively arranged one directly above another. In the preferred case of the use of hollow-cylindrical trimming bodies, the latter are then fixed during mounting in each case simultaneously with the same centering pin via the corresponding holes in the trimming disk.

The described arrangement of the trimming bodies on the trimming disk is also suitable, in particular, for an application in the context of the second, fourth and fifth described embodiments of methods according to the invention.

Preferably, the ring-shaped region with the trimming bodies is arranged concentrically on the trimming disk. Preference is given, in particular, to an arrangement which ensures that at least one of the trimming bodies in each case temporarily runs with part of the area thereof beyond the inner and outer edges of the region of the working layers that is swept over by the workpieces processed in the grinding apparatus.

It has been found that, as a result of wear of the working layer during the grinding processing of workpieces, a trough-shaped depression ("traveling track") develops in the working layer within the region swept over by the semiconductor wafers. Since the working layer is then no longer flat, the semiconductor wafers, with increasing wear of the working layer, assume an increasingly non-flat—convex—shape, which is undesirable and necessitates trimming of the working layer. It has furthermore been found that a sufficient planarity of the working layer as a prerequisite for obtaining flat semiconductor wafers can be achieved only if, during trimming, the trimming bodies 8 (FIGS. 3, 4) on the trimming disk 9 with toothing 10 sweep over a region extending beyond the region previously swept over by the semiconductor wafers. It is only in that case that, as a result of the trimming, the trough-shaped depression in the working layer on account of wear is removed and a planar region is produced which projects beyond the region swept over by the semiconductor wafers again during the subsequent processing, with the result that the semiconductor wafers again "see" a flat working layer as a prerequisite for obtaining particularly flat semiconductor wafers.

DE102007013058A1 discloses that the working layer is advantageously already dimensioned such that the semiconductor wafers at times extend with part of their area beyond the edge of the working layer by a certain amount. A trough-shaped depression cannot then form in the event of wear of the working layer. However, in the case of such an "excursion" of the semiconductor wafers, too, the working layers are subjected to radially non-uniform wear (DE102006032455A1), and so they have to be regularly trimmed in order to obtain a semiconductor wafer whose flatness is suitable for demanding applications. In this case, too, the trimming bodies of the trimming apparatus, during trimming, should preferably temporarily pass with part of the area beyond the edge of the region swept over by the semiconductor wafers during processing—and hence beyond the edge of the working layer.

For carrying out the methods according to embodiments of the invention two further measures proved to be advantageous in order to obtain the desired parallelism of the working layers with respect to one another and the substantially planar shape of said working layers.

Firstly, the trimming disk on which the trimming bodies are arranged should have sufficient stiffness and dimensional stability. Trimming disks which deform under the loading forces during the trimming process and in particular when non-flat shapes of the working layers are initially present, which trimming disks thus constantly adapt in part to any unevenness present, are not advantageous for trimming the working layers to the desired defined target shape. Working disks composed of sheet metal having a thickness of 6-10 mm have proved to be sufficiently stiff and dimensionally stable. For reasons of weight, the trimming disk is in this case preferably embodied in ring-shaped fashion, that is to say that only the part within which the trimming bodies are applied is provided, and a lightweight metal (e.g. aluminum) or a composite plastic (e.g. carbon fiber-reinforced epoxy) is chosen as material. The toothing by means of which the trimming apparatus rolls between inner and outer pin wheels of the grinding apparatus between the two working disks with the working layers and which is fixed to the outer circumference of the trimming disk is preferably produced from high-grade steel for durability reasons (abrasion).

Secondly, it was found that the trimming of the working layers to the desired defined target shape succeeds particularly when the surface of the trimming apparatus itself already has a very high degree of plane-parallelism. This is initially not the case after the mounting of the trimming bodies onto the trimming disk, since the sheet metal of which the trimming disk preferably consists has thickness fluctuations and undulations and, moreover, the trimming bodies have individual shape and thickness fluctuations as a result of the sintering process for producing them. Fortunately, it is in the nature of the planetary gearing kinematics that upon relative movement of planets (trimming apparatuses) and working disks, if both friction partners are subjected to wear—the trimming apparatuses as a result of the release of the grain, the working layers as a result of abrasion—precisely a plane-parallel shape is established in the case of the friction partners. It was found, however, that this holds true particularly when the order of the arrangement of the individual trimming apparatuses in the rolling apparatus is changed multiply during such "trimming of the trimming apparatus", since otherwise the cardanically suspended upper working disk always follows possible initial differences in the average thickness of the individual trimming apparatuses by a wobbling movement and a desirable identical thickness of all the trimming apparatuses cannot be produced.

In practice, the procedure in this case is preferably such that a set of trimming apparatuses freshly equipped with trimming bodies that do not have identical thicknesses owing to production are moved relative to one another for a few minutes between used working disks bearing working layers due for replacement, under pressure and with addition of water. The order of the arrangement of the trimming apparatuses in the rolling apparatus formed by inner and outer pin wheels of the grinding apparatus is then changed. The use of four trimming apparatuses arranged at an angle of in each case 90° with respect to one another has proved to be practical. Alternating pairwise replacement of respectively mutually opposite and respectively adjacent trimming apparatuses is particularly expedient in this case. In addition, preferably in each case one of the two trimming apparatuses replaced in pairs can be turned, provided that the construction thereof allows this. (After turning as well, the outer toothing of the trimming apparatus must, of course, engage into the rolling apparatus and be able to move as intended.) As a result of this procedure, a plane-parallel shape of the individual apparatuses and at the same time an identical thickness of all the trimming apparatuses are established after a few repetitions of the process described.

The measures implemented in the context of the third method according to the invention have the effect that the working gap is trimmed exactly in plane-parallel fashion relative to those surfaces of the working layers which become engaged with the semiconductor wafers.

The prior art describes methods and apparatuses with which the profile of the working gap which is formed between the working disks and in which the semiconductor wafers move during processing can be measured and the shape of the working disks can be adjusted, such that a desired radial target shape of the working gap can be set. By way of example, US2006/0040589A1 describes an apparatus comprising two ring-shaped working disks, in the mutually facing surfaces of which, in different radial positions, contactless distance measuring sensors are incorporated, which make it possible to determine the radial profile of the width of the gap formed between the two working disks.

The working disks generally consist of cast steel; the sensors measure the distance "steel to steel". Suitable contactless measuring sensors can be embodied for example inductively, on the basis of the eddy current measurement principle. The apparatus described in US2006/0040589A1 can furthermore alter the shape of one of the working disks in a targeted manner. This is possible for example thermally by means of two stacked, differently temperature-regulated cooling labyrinths in the working disk ("bimetallic effect"). DE102007013058A1 describes a method by which the working gap can be kept substantially constant despite deforming forces that have an effect during processing. However the prior art does not disclose how a uniform basic shape of the working gap can be obtained such that, in the context of the measurement and adjustment possibilities described above, overall it is possible to produce a gap profile which is so uniform that plane-parallel semiconductor wafers can be produced.

Specifically, it has been found that the methods known in the prior art permit only very restricted and long-wave adjustment possibilities and the resultant shape is detected only at a small number of support points (measurement points), such that only an average gap gape, and in the optimum case also a gap curvature can be set. Consequently, only a change of the first order and at most second order of the real gap thickness d=d(r) is possible, if the latter is described for example by a polynomial: $d=d_0+d_1 \cdot r+d_2 \cdot r^2+d_3 \cdot r^3+ \ldots$ (r=radius, $d_0$=average gap distance, $d_1$=gap gradient [gap gape, wedge shape], $d_2$=gap curvature). A fine setting of the gap profile in the short-wave radial length range is not possible in this way. It has furthermore been found that shape trimming in the short-wave range (higher orders of the gap polynomial) is likewise necessary, however.

Embodiments of the invention are based on the observation, then, that in this case the shape of the working disks does not have to be trimmed exactly in planar fashion at all; rather it suffices for the working layers applied on the working disks to be trimmed in plane-parallel fashion with respect to one another. The trimming of the working layers to form a planar surface is effected in the third method according to the invention by material removal from the working layers in such a way that the thickness profile of the working layer after trimming is exactly complementary to the deviation of the surface of the underlying working disk from an ideal plane. Any working layer trimmed according to the invention therefore compensates for the remaining unevennesses of the underlying working disk. Since the measurement methods described in the prior art only determine the gap profile between the working disks ("steel to steel"), but not as the actual gap profile between the working layers ("pad to pad"), the complementary thickness profile of the working layers that is brought about by trimming has to be determined in order during the subsequent grinding of semiconductor wafers—with corresponding correction—to be able to use the gap profile measurements "steel to steel" for an actual gap profile description "pad to pad".

This is done by firstly measuring the exact radial profile of the surfaces of the working disks relative to one another and also that of the at least one working disk with respect to an absolute reference line. For this purpose, the two working disks without mounted working layers are moved toward one another and kept at a specific distance by, for example, three gage blocks positioned in the area centroids of imaginary uniform 120° segments of the ring-shaped upper working disk. The upper working disk rests on the gage blocks and hence the lower working disk with a pressure that is so low that the constraint deformation by application of pressure is still as small as possible, but that is at least still high enough that the friction of the cardanic suspension of the upper working disk is overcome and the upper working disk rests with substantially identical force on all of the gage blocks. The radial gap profile of the gap distance roughly defined by the gage blocks is then determined precisely using a dial gauge. Afterward, a precision ruler is placed at its Bessel points onto two gage blocks which are set up symmetrically on a diameter of the lower working disk, and the radial profile of the distance between lower working disk and precision ruler is measured using a dial gauge. The latter measurement yields the absolute shape profile of the lower working disk directly; the difference between the former and latter measurements yields the absolute shape profile of the upper working disk.

The working layers (abrasive pads) are then mounted and trimmed to the best possible plane-parallelism by means of the third method according to the invention. This is checked by the working disks with the trimmed working layers being moved towards one another onto gage blocks—the gage blocks then determine the measurement distance pad to pad—and the radial gap profile is determined by means of a dial gauge. Afterward, a precision ruler is placed onto the lower working layer by means of gage blocks and the radial shape profile of the lower working layer with respect to the ruler is measured. The former measurement yields the radial profile of the gap width between the working layers, and the latter measurement yields the absolute planarity of the lower working layer and, after difference formation, also that of the upper working layer.

It was found, then, that in order to obtain particularly plane-parallel semiconductor wafers the distance between the working layers is permitted to deviate by not more than ±3 μm over the entire ring width of the ring-shaped working layers in the case of an outer working disk diameter of 2000 mm and a ring width of a good 650 mm (parallelism of the working gap formed between the working layers), but that the wedge shape and curvature of one of the two working layers with respect to a reference straight line (measurement relative to the precision ruler) together are permitted to be up to 100 μm over the entire ring width of 700 mm, but the higher orders of the shape deviation together must be smaller than likewise ±3 μm. The working layers are therefore permitted to be wedge-shaped and curved to a certain degree as long as the parallelism of the working layers with respect to one another is good and there are no higher-order shape deviations.

Figure 2A:
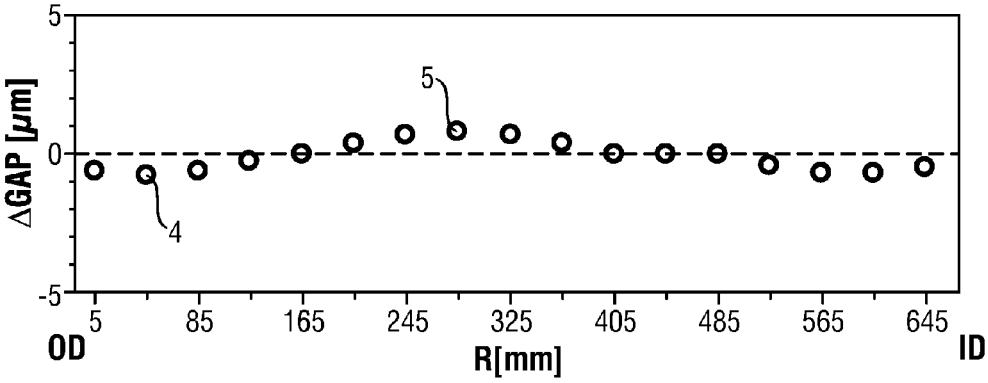
FIG. 2A shows the radial profile of the width of the working gap after trimming of the working layers by means of the third method according to the invention.
Figure 2B:
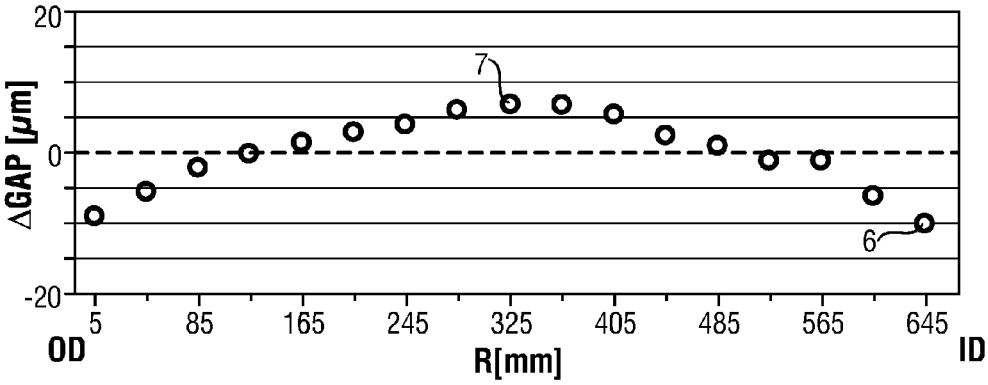
FIG. 2B shows, as a comparative example, the radial profile of the width of the working gap after trimming of the working layers by means of a method not according to the invention.

FIG. 2A shows the relative thickness profile of the working gap formed between the working layers over the radius R of the ring width from the outer diameter OD to the inner diameter ID of the ring-shaped working layers on the ring-shaped working disks after the trimming of the working layers by means of the third method according to the invention. The ring width of the working layer of the grinding apparatus used is 654 mm. (The first and the last 5 mm of the working gap cannot be measured on account of the size of the bearing and measurement areas of the gap dial gauge.) In the example according to the invention shown, the relative thickness profile ΔGAP of the gap fluctuates only by −0.8 μm (measurement point with reference symbol 4) to +0.8 μm (measurement point 5). FIG. 2B shows, as a comparative example, a gap profile trimmed by means of a method not according to the invention, in accordance with the prior art. The gap profile deviates from the desired plane-parallel profile (ΔGAP=0) by −10 μm (measurement point 6) to +7 μm (measurement point 7).

Figure 3A:
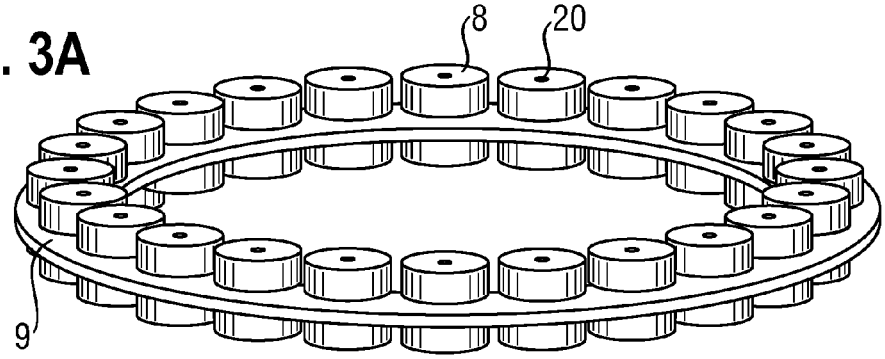
FIG. 3A shows elements of a trimming apparatus suitable for carrying out the fifth method according to the invention.
Figure 3B:
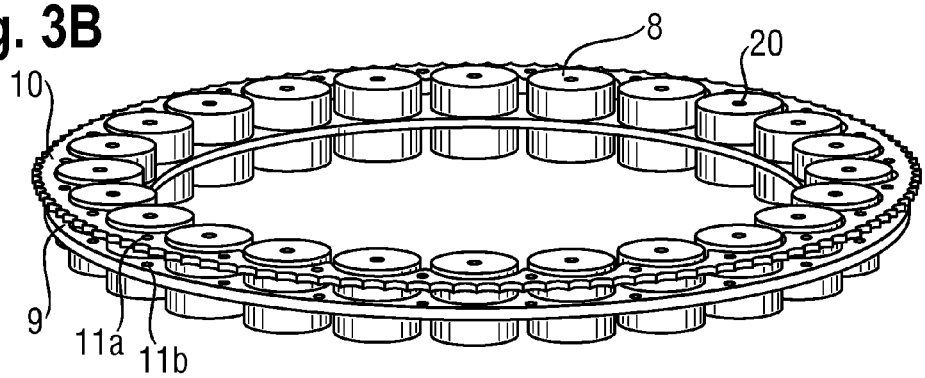
FIG. 3B shows a complete trimming apparatus suitable for carrying out the fifth method according to the invention.

Four trimming apparatuses of an embodiment as shown in FIG. 3B were used in the example shown (FIG. 2A). Each trimming apparatus consisted of a trimming disk 9, on which, on the front and rear sides, in each case 24 hollow-cylindrical trimming bodies with a diameter of 70 mm, a hole having a diameter of 10 mm and an initial height of 25 mm, which were adhesively bonded on a pitch circle having a diameter of 604 mm, and an outer toothing 10, which engages into the rolling apparatus composed of inner and outer pin wheels of the grinding apparatus. The supporting area proportion, that is to say the area proportion of the hence 70 mm wide ring of the trimming body arrangement which is covered with trimming bodies, was therefore around 68%, and the trimming bodies during the rolling movement all passed beyond the outer and inner edges of the ring-shaped working layer symmetrically by 10 mm. The working disk consisted of 10 mm thick aluminum, that is to say was very stiff. The trimming bodies, which initially had non-uniform heights after adhesive bonding, were firstly brought to uniform thickness by relatively long running of the trimming apparatus on an old, almost completely worn working layer that was due to be changed, under pressure and with addition of water, with the result that trimming apparatuses that were highly precisely identical in thickness and plane-parallel were available. In this case, the trimming apparatuses were firstly exchanged in pairs in each case after a few minutes (1 for 3, 2 for 4; then 1 for 2 and 3 for 4) and additionally turned. (For the latter, the outer toothing 9, FIG. 3B, has to be mounted from the front side to the rear side of the trimming disk in order to be able to engage into the pin wheels of the grinding apparatus again after the turning of the trimming apparatus. This is complicated and actually only necessary once during the basic trimming of the trimming apparatus after the mounting of new trimming bodies.)

The working layer was trimmed by means of a plurality of trimming cycles with alternating drive directions of upper and lower working disks and inner and outer pin wheels of the grinding apparatus. The rotational speeds of the upper, lower, inner, outer drives were in this case +9.7; −6.3; +6.4; +0.9 RPM (revolutions per minute), and upon reversal correspondingly −9.7; +6.3; −6.4; −0.9 RPM (all drives viewed from above the grinding apparatus, "+"=clockwise direction, "−"=counterclockwise direction). In this case, the upper working disk rested with a force of 1 kN, corresponding to a pressure of approximately 2.7 kPa between trimming bodies and working layer. The trimming time was 4×1 min, and 0.5 to 1 l/min of water was added to the working gap continuously during trimming. The four trimming apparatuses were exchanged in pairs once. They were inserted into the rolling apparatus uniformly every 90°.

In the comparative example of trimming not according to the invention, which led to the radial profile of the working gap thickness as shown in FIG. 2B, trimming apparatuses were used wherein, on each side, in each case 61 trimming bodies having a diameter of 70 mm and a hole having a diameter of 10 mm were arranged substantially uniformly over the entire area of the trimming disk. The individual trimming bodies thus had the same dimensions as in the example according to the invention. In the same way as in the example according to the invention, 24 trimming bodies were mounted on a pitch circle diameter of 604 mm, but in addition 18 on pitch circle diameter 455 mm, 12 on pitch circle diameter 305 mm, 6 on pitch circle diameter 155 mm and one trimming body in the center. All the trimming bodies were arranged uniformly on the respective pitch circles, and this resulted overall in virtually uniform covering of the entire circular area, i.e. with small fluctuations in distances (7 to 11 mm) between each trimming body and its neighbours. The bearing force was increased to somewhat above 2.5 kN, thus resulting in a same pressure of 1 kPa as in the case of the trimming carried out according to the invention (FIG. 2A). Rotational speeds and pairwise exchange and single turning took place as in the case of the trimming example according to the invention, and identical trimming durations were chosen.

In the fourth described embodiment of a method according to the invention, firstly the radial shape profile of the two working layers is measured and the minimum material removal required for reestablishing a flat surface is determined therefrom for each of the two working layers. Afterward, the trimming process is carried out by means of at least one trimming apparatus (for example as described for the third or fifth method according to the invention). In this case, the removal rates from the upper and the lower working layer are set by means of a suitable choice of the flow rate of the cooling lubricant and also of the pressure with which the upper working disk is pressed against the lower working disk during trimming such that their ratio corresponds to the ratio of the minimum material removals.

Preferably, in this case each working layer is trimmed in such a way that material is removed on average radially uniformly, such that the working layer in particular does not become "wedge-shaped" from the inside toward the outside. As a result of such uniform wear, the longest possible overall service life of the working layer is made possible and the working gap between the surfaces of the working layers, even after a plurality of such trimming cycles, always runs substantially parallel to the gap between the working disks, thus resulting in constant positional and hence operating conditions.

The working disks, which are usually produced from cast steel, are originally trimmed once after assembly of the grinding apparatus by the manufacturer in each case by themselves (stationary dressing apparatus), and relative to one another (double-side lapping) and have in each case lapping- and dressing-typical radial unevennesses. The latter were determined at a chosen temperature and for different pressures of the hydraulic plate shape adjustment of the upper working disk beforehand, as described above in the context of the third method according to the invention, in a relative fashion (gage blocks) and in an absolute fashion (ruler) and subsequently remain unchanged as apparatus-specific features. The working layers are mounted and their radial thickness profile is measured. For this purpose, the working layers are provided, on at least one radius, with a plurality of holes through which the underlying working disk can be sensed by means of a thickness probe. From the resultant radial thickness profile of the working layers and the known shape profile of the working layer it is thus possible to determine the shape profile of each working layer in absolute fashion and of the two working layers relative to one another. In accordance with this working layer measurement, the temperatures of both working disks and the hydraulic shape adjustment pressure of the upper working disk are set in such a way that the course of the working gap formed between the working layers is as plane-parallel as possible. In this case, parallelism has priority over planarity. The latter, after all, is only intended to be established by the trimming of the working layers.

After a fresh working layer has been mounted, it initially has to be subjected to basic trimming since, owing to production, it is not flat and as yet there is no abrasive exposed at its surface. In this case, the topmost plastic layer is removed. In the case of the PPG abrasive pad Trizact™ Diamond Tile 677XA from 3M Company, approximately 50 μm of material have to be removed in order to uncover abrasive (production of the cutting property), and in addition initially 50-100 μm in order to compensate for unevennesses of the working disk shape. The exact value of the last-mentioned minimum removal for compensating for the working disk unevenness depends on the accuracy with which the working disks were initially subjected to basic trimming, and is therefore individually different from one specimen of a grinding apparatus to another. The working layer trimmed in this way is then used for grinding, until, despite the procedurally customary measures of shape tracking of the working gap via temperature and hydraulic pressure, the flatness of the semiconductor wafers obtained exceeds a predefined limit, for example TTV >3 μm for three successive passes despite good setting of a best possible plane-parallelism of the working layers with respect to one another. The wear-induced decrease in thickness and alteration of the shape of the working layers are determined by thickness measurement as described. The difference between the thickness profile measured in this way for each of the two working layers and the reference profile trimmed in plane-parallel fashion beforehand yields, for each working layer, the average thickness reduction (average wear) and the shape deviation (radial wear profile). The trimming according to the fourth method according to the invention is then performed such that the amount of material removed from each of the two working layers is exactly the amount by which the shape after wear deviates from the shape after plane-parallel trimming During the trimming process, generally only a small volumetric flow of cooling lubricant (e.g. water) is added to the working gap, to be precise on the one hand as much as necessary to just still provide sufficient cooling and to support uniform sliding or rubbing of the trimming bodies on the working layers (no "stick and slip", no squealing), but on the other hand also as little as possible to produce a high friction between trimming bodies and working layers, such that the trimming bodies release enough abrasives to bring about a removal effect. For the example of an apparatus for the PPG processing of semiconductor wafers with ring-shaped working disks having an outer diameter of almost 2000 mm and a ring width of a good 650 mm, a volumetric flow rate of 0.3 to 3 l/min of water fed to the working gap during the trimming process proved to be optimal. Systematic variations of the water flow rate and also the intensity with which the porous trimming bodies had been "watered" (had been able to become saturated with water) before the trimming process then showed that, as a result of an increased addition of water during the trimming process, the friction of the trimming bodies on the lower working layer could be reduced, with a correspondingly reduced material removal from the lower working layer relative to the upper working layer. Since the water that was fed accumulates on the lower working disk owing to the force of gravity, partial "floating" (aquaplaning effect) was evidently able to be achieved here.

It is known that the trimming effect is determined by the path speed with which the trimming bodies are guided over the working layers, and by the pressure between trimming bodies and working layers. The faster and the more pressure under which the trimming bodies are moved, the greater the material removal from the working layers that is effected during trimming A desired material removal can thus be achieved by means of a short trimming process at great pressure (and higher path speed) or by means of a correspondingly longer trimming process at lower pressure (and, if appropriate, lower path speed). It was then found that the inherent weight of the trimming apparatus becomes increasingly significant at ever lower trimming pressures. Therefore, with a decreasing trimming pressure, the force exerted on the upper working layer decreases to a greater extent than the force exerted on the lower working layer. This situation is correspondingly applicable to the material removals. Therefore, by reducing the trimming pressure it is possible to reduce the material removal from the upper working layer to a greater extent than the material removal from the lower working layer.

It was then found that, by means of trimming with additional addition of cooling lubricant or reduced trimming pressure, material removal from both working layers that is asymmetrical within wide limits can be obtained, to be precise such that in a targeted manner less material was removed from the lower working layer relative to the upper working layer (addition of cooling lubricant) or in a targeted manner more material was removed from the lower working layer relative to the upper working layer (decrease in pressure). Depending on the results of the measurement of the shape profile of the worn working layers, addition of cooling lubricant and trimming pressure can also be chosen precisely such that the material removal from both working layers is exactly identical.

The removal asymmetry that can be obtained by additional addition of cooling lubricant (e.g. water) is determined by the thickness of the water film which can be established between lower trimming bodies and lower working layer. The water film is all the thicker, and thus the material removal from the lower working layer is all the smaller, the larger the working area of the trimming bodies. Likewise, the material removal from the lower working layer is all the smaller, the larger the above-described islands and the supporting area proportion (ratio of the area of the islands to the total area of the abrasive pad) of the lower working layer. In practice, a ratio of the removal rates of the upper working layer to those of the lower working layer of up to 3:1 was achieved by addition of cooling lubricant.

A practical limit of the asymmetrical material removal rates of upper with respect to lower working layer that are obtainable by utilizing the weight force of the trimming apparatuses is given only by the minimum bearing force with which the upper working disk has to be pressed on in order to overcome the frictional forces in its cardanic mounting and thus always bear securely on the trimming apparatuses. If this force is undershot, the upper working disk wobbles or "dances" (partial lifting-off), and a flat working layer cannot be obtained. A ratio of the removal rates of the upper with respect to those of the lower working layer of up to 1:3 can be achieved in practice.

In the case of the grinding apparatus mentioned by way of example, pressures of between 1 and 20 kPa proved to be expedient pressure ranges for trimming with substantially identical removal rates of upper and lower working layers; pressures of between 2 and 12 kPa are particularly preferred. In the case of the grinding apparatus mentioned by way of example, preferred volumetric flow rates of the cooling lubricant fed to the working gap for a substantially identical material removal from upper and lower working layers are between 0.2 and 5 l/min; volumetric flow rates of between 0.5 and 2 l/min are particularly preferred. In the stated ranges for volumetric flow rate and pressure, not all combinations are suitable for obtaining a symmetrical material removal. Thus, cooling lubricant volumetric flow rates at the upper end of the specified ranges have to be chosen for trimming pressures at the lower end of the specified preferred ranges, and vice versa, in order that the gravity effect (inherent weight of the trimming apparatus) which then already occurs and the sliding effect (floating in the case of a large amount of cooling lubricant) compensate for each other, and vice versa.

In order to obtain a reduced material removal rate of the lower working layer compared with the upper working layer during trimming in the grinding apparatus mentioned, cooling lubricant volumetric flow rates of between 2 and 10 l/min at pressures of at least 4 kPa proved to be suitable in order that the floating effect is not nullified again by the inherent weight effect of the trimming apparatus. Conversely, an increased material removal rate of the lower working layer compared with the upper working layer can be obtained if the pressures during trimming in the processing apparatus mentioned by way of example are below 4 kPa at cooling lubricant volumetric flow rates of below 4 l/min.

A grinding apparatus suitable for carrying out the methods according to the invention, as described in DE19937784A1, for example, was used for all indications. The outer diameter of the working disks was 1935 mm with a ring width of 686 mm. The working layers were chosen to be somewhat smaller than the working disks with an outer diameter of 1903 mm and a ring width of approximately 654 mm. The trimming pressure is established by way of the applied load of the upper working disk. Four trimming apparatuses such as have been described as an exemplary embodiment with respect to the third method according to the invention were used during the trimming process, thus resulting in this case, too, in a temporary excursion of the trimming bodies by up to 10 mm beyond the outer and inner edges of the ring-shaped working layers.

By selecting abovementioned ranges for pressure and volumetric flow rate during trimming, it was possible to vary the ratio of the material removal rates of upper with respect to lower working layer between approximately 0.3 and 3. In this case, the working layers had an average grain size of the abrasives (diamond) bonded therein of 2 to 6 μm, and the material of the trimming bodies was porous high-grade corundum pink having a grain size of approximately 5 to 15 μm.

Trimming apparatuses whose outer toothing is height-adjustable relative to the trimming disk are used in the fifth described embodiment of a method according to the invention.

According to the prior art, the rolling apparatuses, that is to say the inner and outer drive rings of an apparatus suitable for carrying out a PPG method are not height-adjustable, or are height-adjustable only to a small extent, for structural reasons. This results from the necessity of stiff, play-free and precise guidance of the toothed rings or pin wheels which form the rolling apparatus. In order that a trimming tool with its outer toothing can engage securely into the rolling apparatus, according to the prior art said trimming tool either has to be very thin or has to support a toothing projecting asymmetrically toward one side ("trimming pot"). This leads to insufficient planarity of the working layer trimmed in this way, because the trimming tool can be deformed.

Moreover, it is possible to use only trimming bodies having a small height, at least for those which become engaged with the lower working disk. Since these are subject to wear, they have to be frequently changed or even the entire trimming apparatus has to be discarded after wear. This leads to high consumption costs, frequently changing trimming conditions with long set-up times and thus to non-reproducible process conditions. The trimming disk bearing the trimming bodies and a toothing could be made sufficiently thick and thus advantageously stiff as long as it is still ensured that at least a portion of the pins of the inner and outer pin wheels of the grinding apparatus still engages into at least a portion of the toothing of the trimming apparatus; here as well, however, the disadvantage remains that the trimming bodies engaging with the lower working layer would have to be very thin—with the discussed disadvantages for economic viability and process stability of the grinding method. In the case where the trimming tool is embodied as an asymmetrical "trimming pot", it is likewise possible to use only trimming bodies having a small thickness or it is possible to use only the small part of thicker trimming bodies which projects beyond the toothing, that is to say the remaining part of the difference between the height of the rolling apparatus (pin or tooth height) and the depth of the engagement of the toothing of the trimming tool into the rolling apparatus.

FIG. 3 illustrates various embodiments of the trimming apparatus used for the fifth described embodiment. In order that all of the essential elements can be made visible, the trimming apparatuses shown in FIG. 3 are illustrated upside down, that is to say that the trimming bodies at the top in FIG. 3 trim the lower working layer and the partly concealed trimming bodies at the bottom trim the upper working layer. (Inner and outer pin wheels of grinding apparatuses suitable for carrying out the method according to the invention are generally arranged on inner and outer circumference and at the level of the lower working disk, although an arrangement, with additional outlay and without advantage, would be possible, in principle, on the upper working disk, too.)

FIG. 3A shows the annular trimming disk 9, on which trimming bodies 8 are arranged. (The trimming disk 9 can also be embodied in circular fashion, but this is not preferred for reasons of weight.) The trimming bodies 8 can be fixed on the trimming disk 9 by means of adhesive bonding, screwing—FIG. 3A shows trimming bodies having suitable holes 20 for screwing or for centering in the case of adhesive bonding—or other customary methods. FIG. 3B shows the complete trimming apparatus according to the invention, comprising a trimming disk 9, trimming bodies 8 and an outer toothing 10. The outer toothing 10 is separate from the trimming disk 9. Both are preferably screwed to one another by corresponding holes 11*a* in the toothing and 11*b* in the trimming disk. The connecting screws are not shown, for reasons of clarity. By means of different lengths of the screws and spacers (sleeves), it is possible to adapt the distance between toothing and trimming disk as desired. If the trimming bodies 8 wear and lose height during trimming use, the screw connection can thus always be readjusted such that the trimming bodies 8 only in each case just project beyond the toothing. As a result, a trimming apparatus of this type can also be used in the case of grinding apparatuses having rolling apparatuses that are not or are only slightly height-adjustable or those having short pins or teeth, and it is ensured according to the invention that the outer toothing never comes into contact with the working layers in the course of the wear of the trimming bodies. The outer toothing is preferably composed of a metallic material and particularly preferably composed of steel or high-grade steel, and contact between the steel and the diamond preferably used as abrasive in the working layer is thus avoided. This is because it is known (DE102007049811A1) that contact and abrasion with iron metals cause diamond to become blunt, as a result of which the grinding method would not be able to be carried out or would be able to be carried out only with considerable additional outlay (frequent redressing of the working layers) and poor results (process instability as a result of frequent interruption for redressing).

Figure 3C:
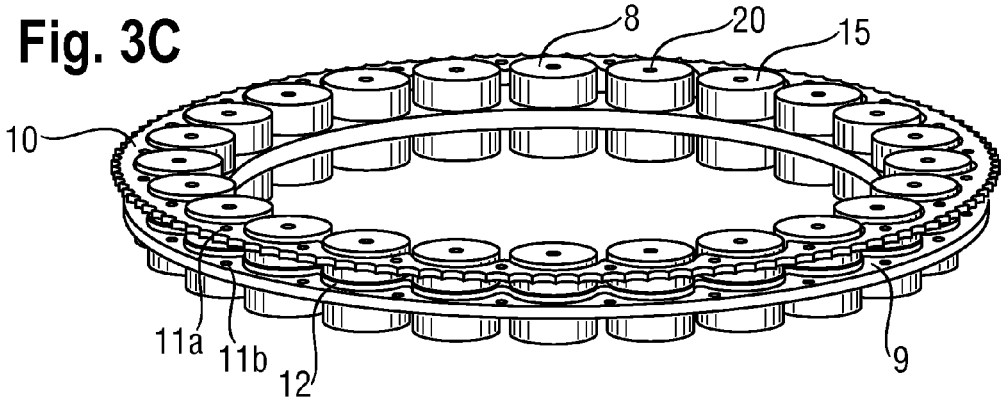
FIG. 3C shows a further trimming apparatus suitable for carrying out the fifth method according to the invention, comprising thick trimming bodies.
Figure 3D:
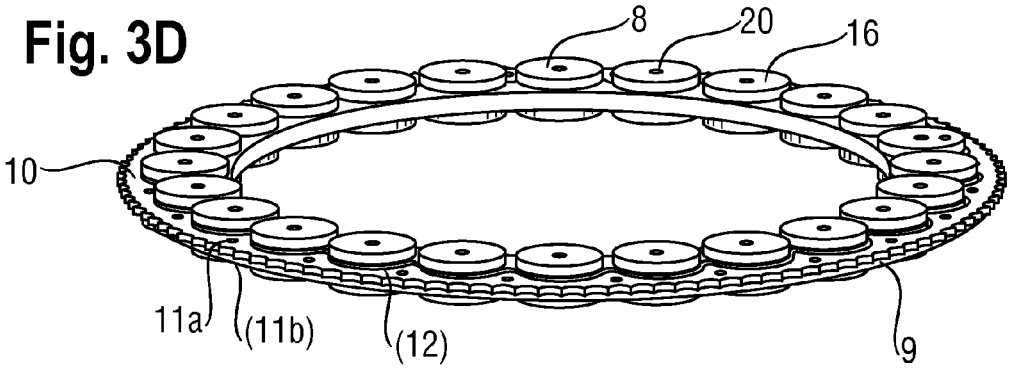
FIG. 3D shows the trimming apparatus illustrated in FIG. 3C, with thin worn trimming bodies.
Figure 5:
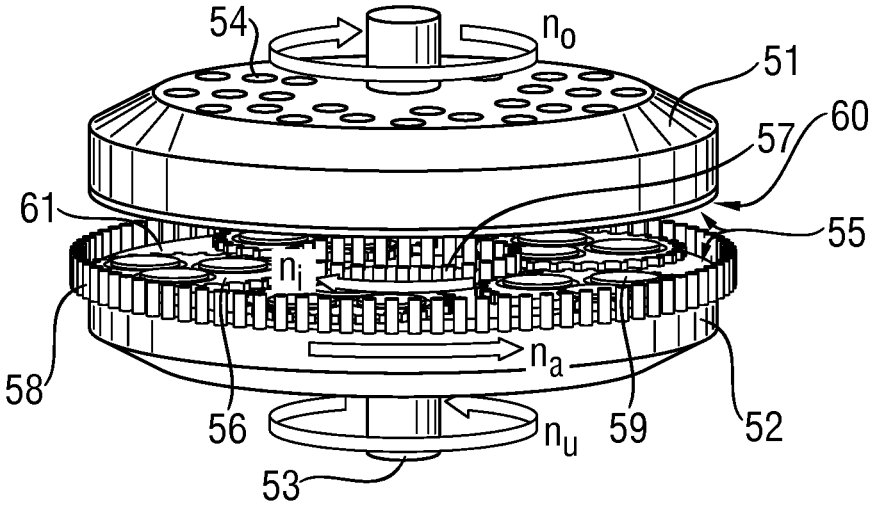
FIG. 5 shows a grinding apparatus whose working layers can be trimmed by means of the methods according to the invention.

FIG. 3C shows one preferred embodiment, wherein the trimming bodies 8 are adhesively bonded or screwed onto a shoulder 12 incorporated into the trimming disk 9. As a result, the outer toothing 10 can descend into the working disk 9 in such a way that its upper edges become situated in an areally flush manner. As a result, the trimming bodies 8 can be used completely up to their adhesive bonding or screw connection with the trimming disk. FIG. 3C shows the trimming bodies 8 with a still large useful height 15, and FIG. 3D shows them after almost complete wear (small remaining useful height 16) and with toothed ring 10 having descended into the working disk 9.

The invention thus permits the use of comparatively thick trimming bodies and at the same time the use of their complete thickness. Therefore, the trimming apparatuses according to the invention have to be replaced or equipped with new trimming bodies significantly less often than in accordance with the prior art.

Trimming bodies suitable for carrying out the second to fifth described embodiments according to the invention are available from various manufacturers for grinding materials. The hard substances known in the prior art for grinding purposes, such as, for example, (cubic) boron nitride (CBN), boron carbide ($B_4C$), silicon carbide (SiC, "carborundum"), aluminum oxide ($Al_2O_3$, "corundum"), zirconium oxide ($ZrO_2$), silicon dioxide ($SiO_2$, "quartz"), cerium oxide ($CeO_2$), and mixtures thereof, can be used. These materials are generally—to form abrasive bodies—pressed, sintered, metallic, glass- or plastic-bonded and can be used as trimming bodies for carrying out the methods according to the invention. Alongside grain type and grain mixture, grain size and grain size distribution, these abrasive bodies are characterized by bonding type and bonding hardness, porosity, fillers, etc. What can be important is the targeted release of the material bonded in the trimming bodies upon movement under pressure and with addition of cooling lubricant (e.g. water) over the working layers. The abovementioned properties of the abrasive bodies used as trimming bodies are generally not communicated in detail by the abrasive manufacturers and, if they are so communicated, then comparability between different abrasive bodies, in particular between different manufacturers, is often not possible, owing to lack of communication of the precise measurement conditions under which these parameters were determined. In particular the bonding hardness, which crucially determines the release of grain that is essential to the invention, differs from manufacturer to manufacturer and is designated by their own in-house parameters.

Therefore, the best procedure adopted in practice is such that firstly various commercially conventional abrasive bodies from one or more manufacturers are tested for suitability as trimming bodies, in which case the grain sizes and bonding hardnesses stated by the manufacturer are initially regarded only as guide values. If the abrasive body proves to be too soft, an abrasive body designated as harder in the manufacturer's internal nomenclature is used. If it proves to be too hard, a softer one is correspondingly used. If the rate of material removal from the working layer is too high and the working layer has a significantly rougher surface directly after trimming than after a few passes of grinding use, when a self-dressing equilibrium has become established, a finer grain in accordance with information from the manufacturer is chosen; in the case of insufficient material removal and the absence of a dressing effect on the working layer, a correspondingly coarser grain is chosen. On account of the good availability of a wide range of hardnesses, grain sizes, etc., this is always possible easily and through a small number of experiments. By way of example, the trimming bodies used in the exemplary embodiments were found after only four experiments with different abrasives from only one manufacturer, as a result of which the empirical selection method described proved to be practicable.

Initially any trimming tool that has a removing effect on another material by its nature releases material, whether this is desired or not. According to the invention, however, this takes place for the methods described here to precisely such an extent that during the trimming process a layer of released grain is situated between trimming body and working layer, the thickness of which is on average between a half diameter and ten diameters of the average size of the released grains. Specifically, if the rate at which grain is released is too low, only an inadequate trimming effect takes place (too slow, uneconomic). If the rate is too high, such that a layer thicker than ten average grain diameters is formed on average, then the trimming apparatus pre-trimmed in an extremely plane-parallel manner as described can no longer have a sufficient shaping effect on the working layer ("copying" of the reference planarity), but rather is "blurred" by the thick, undefined film of loose trimming grain and—with admittedly high capacity for material removal from the working layer—it is not possible to obtain a working layer form which is plane-parallel according to the invention.

It goes without saying that it is particularly advantageous to combine two or more of the methods according to the invention. In particular, the features of the trimming apparatuses used in the third and fifth-described methods according to the invention can be combined with one another without any problems. Advantageously, trimming apparatuses having the features of the trimming apparatuses used in the third or fifth method are likewise used in the second and fourth-described methods according to the invention. Particularly preferably, trimming apparatuses having the features of the trimming apparatuses used in the third and fifth methods according to the invention are used in the second and fourth-described methods according to the invention. The second and fourth-described methods according to the invention can also advantageously be combined.

While the invention has been particularly shown and described with reference to preferred embodiments thereof, it will be understood by those skilled in the art that various changes in form and details may be made therein without departing from the spirit and scope of the invention.

LIST OF REFERENCE SYMBOLS

1 low material removal rate after trimming not according to the invention

2 high material removal rate after trimming not according to the invention

**3*a*** material removal rate achieved during processing in one direction of rotation after trimming according to the invention

**3*b*** material removal rate achieved during processing in an opposite direction of rotation after trimming according to the invention

4 small local working gap width after trimming according to the invention

5 large local working gap width after trimming according to the invention

6 small local working gap width after trimming not according to the invention

7 large local working gap width after trimming not according to the invention

8 trimming body

9 trimming disk

10 outer toothing

**11*a*** hole in toothing

**11*b*** hole in trimming disk

12 shoulder in trimming disk for lowering the toothing

15 trimming body with large remaining useful height

16 trimming body with small remaining residual useful height

17 pitch circle of the arrangement of the trimming bodies on the trimming disk

**18*a*** external diameter of the ring-shaped region within which the trimming bodies are arranged on the trimming disk

**18*b*** internal diameter of the ring-shaped region within which the trimming bodies are arranged on the trimming disk

19 further pitch circle of the arrangement of the trimming bodies on the trimming disk

20 fixing or centering holes of the trimming bodies

51 upper working disk

52 lower working disk

53 rotational axis

54 holes for feeding cooling lubricant

55 working gap

56 carrier

57 inner guide ring

58 outer guide ring

59 workpiece

60 upper working layer

61 lower working layer

What is claimed is:

1. A method for trimming two working layers including bonded abrasive applied on mutually facing sides of an upper and lower working disk of a grinding apparatus configured for simultaneous double-side processing of flat workpieces, the method comprising:

providing at least one trimming apparatus including a trimming disk, a plurality of trimming bodies and an outer toothing;

rotating the working disks;

moving the at least one trimming apparatus between the rotating working disks using a rolling apparatus and the outer toothing under pressure with an addition of cooling lubricant that contains no substances with abrasive action, the moving being on cycloidal paths relative to working layers of the working disks;

contacting the working layers with the trimming bodies so as to release abrasive substances from the trimming bodies and so as to effect material removal from the working layers as a result of loose grain; and changing a direction of drives of the grinding apparatus at least twice during trimming.

2. The method recited in claim 1, wherein the material removal from the working layers associated with a respective change in direction of rotation decreases with each change in direction.

3. The method recited in claim 1, wherein the material removal from each of the two working layers between a last change in the direction of rotation and an end of trimming is between 10% and 100% of an average grain size of an abrasive grain bonded in the working layers.

4. The method recited in claim 1 wherein each of the working layers is elastic and is detachable from a respective working disk by a peeling movement and includes at least the three following layers:

a useful layer, facing away from the working disk, including bonded abrasive and having a useful thickness of more than one abrasive grain layer;

a central continuous support layer supporting the useful layer and connecting elements of the useful layer to form a continuous unit; and a mounting layer facing the working disk and forming a force-locking or positively locking composite assembly with the working disk over a period of a usable life of the useful layer.

* * * * *